United States Patent [19]

Mainprice

[11] 4,257,636

[45] Mar. 24, 1981

[54] BAG AND BAG AND SCOOP DEVICE COMBINATION

[76] Inventor: Peggy L. Mainprice, 4210 NE. 85th St., Seattle, Wash. 98115

[21] Appl. No.: 73,887

[22] Filed: Sep. 10, 1979

Related U.S. Application Data

[63] Continuation-in-part of Ser. No. 1,530, Jan. 8, 1979.

[51] Int. Cl.[3] ..... A47F 13/06

[52] U.S. Cl. ..... 294/1 BA

[58] Field of Search ..... 294/1 B, 1 BA, 1 BB, 294/19 R, 55; 15/257, 1; 141/108; 150/7; 229/62; 248/95, 99

[56] References Cited

U.S. PATENT DOCUMENTS 3,659,891 5/1972 Pettenon et al. ..... 294/1 BA

FOREIGN PATENT DOCUMENTS 2730834 1/1979 Fed. Rep. of Germany ..... 294/1 B

*Primary Examiner*—James B. Marbert

*Attorney, Agent, or Firm*—Seed, Berry, Vernon & Baynham

[57] ABSTRACT

A unique bag shape for use in attaching to a scoop device of the type suitable for scooping animal feces or other debris from the ground. The bag is provided with a perforation which goes over the handle of the scoop device such that a skirt is formed which covers the exterior of the bag. This skirt becomes folded inwardly and becomes a part of the inside of the bag when the bag is removed.

6 Claims, 4 Drawing Figures

BAG AND BAG AND SCOOP DEVICE COMBINATION

CROSS-REFERENCE TO RELATED APPLICATIONS

This invention is a continuation-in-part of my earlier application Ser. No. 001,530 filed Jan. 8, 1979.

BACKGROUND OF THE INVENTION

Field of the Invention

This invention relates to improvements in a bag for collecting animal waste and particularly to a bag which is attached to a hand-held scoop device.

In my earlier application Ser. No. 003,530 a hand-held scoop device is provided with an elongated, flexible handle joined to a rim at an obtuse angle. The rim is of flexible steel. Attached to the rim is a disposable bag which preferably is provided with a perforation in the side wall that can slide down the handle until it abuts the rim. The bag is then reverse-folded through the rim leaving a skirt resiliently attached to the rim for holding the bag onto the rim. The bag is held by the rim and the scoop is swung with a snap action such as with a golf club swing. The scoop device and bag are thus thrust under the feces, lifting it off the ground and into the bag. On some occasions the feces may be soft and sticky such that part of the feces adheres to the ground. In these instances the movement of the bag past the feces to collect the feces will rub the exterior of the bag on the feces adhering to the ground and contaminate the outside of the bag.

SUMMARY OF THE INVENTION

It is an object of this invention to provide an improved bag for use on a scoop device for removing animal wastes or other debris from the ground.

Basically, this object is obtained by folding the skirt of the bag a substantial distance over the remaining length of the bag to cover the exterior of the bag. The skirt is formed from a reverse fold of the bag so that the outside surface of the skirt becomes the inside surface of the bag when the bag is removed and closed. The skirt need not be folded the full length of the bag but should cover a substantial part of the exterior of the bag. When the bag is drawn across the ground to collect a soft feces, any parts of the feces remaining attached to the ground will rub against the wall of the skirt rather than the wall of the exterior of the bag. In this manner the bag when removed from the rim will have the contaminated skirt exterior wall turned inward as the bag is removed. Thus the exterior of the bag is clean and free of any contaminating material collected within the bag. The bag can then be sealed and disposed of. Preferably, the length of the skirt is determined by a hole placed in the side wall of the bag which hole is slid onto the handle of the scoop device until it is positioned against the rim of the scoop device.

DETAILED DESCRIPTION OF THE PREFERRED EMBODIMENT

The scoop device includes a flexible handle 39 joined at an angle to a flexible continuous rim 44. As discussed in parent application Ser. No. 001,530, the rim and handle are flexible so as to provide a snapping, sweeping action when moved forward across the ground much as in a golf club swing.

Figure 1:
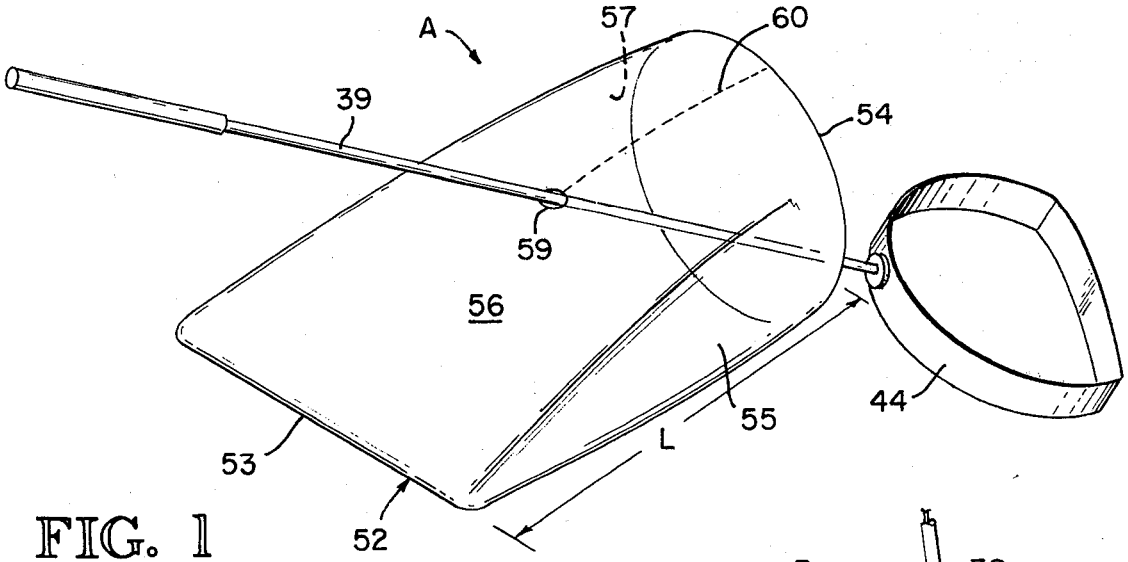
FIG. 1 is an isometric view of a scoop device and bag embodying the principles of the invention.
Figure 2:
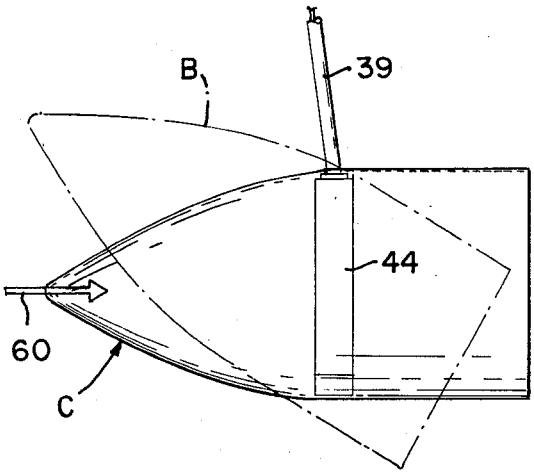
FIG. 2 is a side elevation of the scoop device with the bag being installed.
Figure 3:
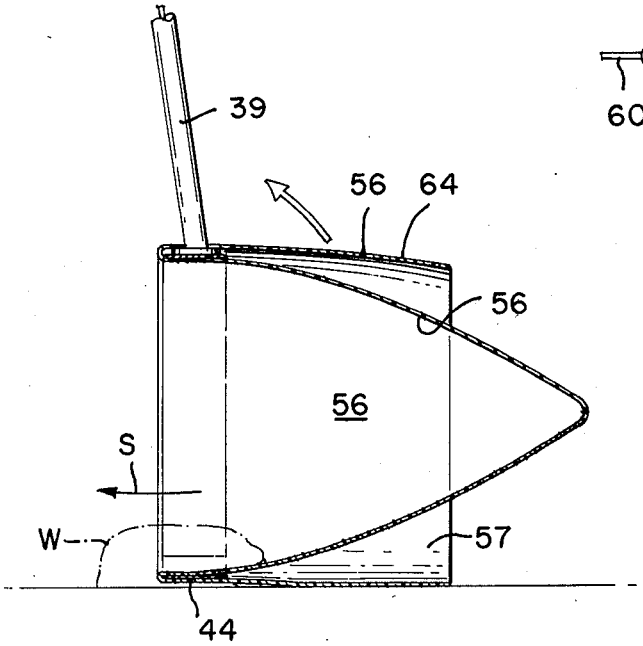
FIG. 3 is a fragmentary side elevation of the scoop device with the bag installed in position ready for collection of the waste material.
Figure 4:
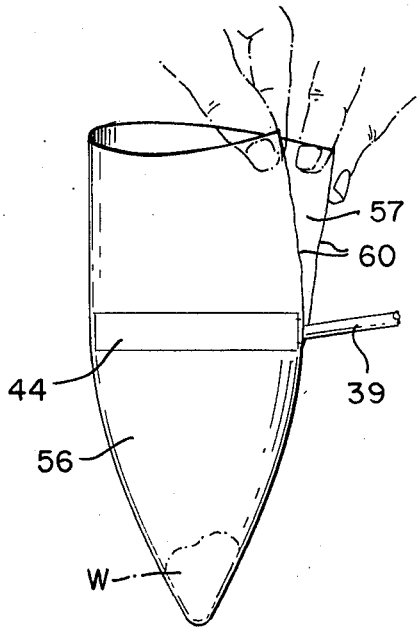
FIG. 4 is a schematic illustrating removal of a bag.

A bag 52 is provided and is adapted to be positioned over the rim in a collecting condition as best shown in FIG. 3. The bag is preferably provided with a closed end 53 and an open end 54. Side walls 55 are provided between the closed and opened ends with an exterior surface 56 and an interior surface 57. Preferably, the bag is provided with a perforation or opening 59 that is positioned in from the open end of the bag approximately 40 percent of the length "L" of the bag. A perforated line 60 joins the perforation 59 to the open end of the bag so that upon removal the bag can merely be pulled free of the opening 59 with the shaft splitting the perforated line 60. Once freed, the open end of the bag 54 can be drawn tight by spreading and the bag twisted or otherwise sealed.

The bag is installed by slipping the perforation over the handle 39 as indicated by reference character A until the perforation 59 reaches the rim 44; this position is shown by reference B. Next, the bag closed end is pushed through the rim with the closed end reversed and pushed through the open end as shown by arrow 60 in position C. The bag is then turned inside out leaving a skirt 64 encircling the rim and extending almost to the end of the bag as in FIG. 3. As the bag is drawn over the ground in the direction of arrow S through a pile of animal wastes W, it can be seen that on occasion parts of the pile will adhere to the ground and rub across the surface 57 of the skirt 64, depositing some of the waste on the skirt 64 even though most of the waste material gets collected within the bag. The bag can then be pulled through the rim and the skirt outer surface 56 will become an inner surface of the bag, so that the adhering waste material is collected within the bag and will not rub off on the user. While the skirt length shown is a preferred distance, it should be understood that the skirt can be made longer or shorter provided it in most cases will cover sufficient portions of the bag. The preferred range is to place the perforation 59 between 25 and 50 percent of the overall length L of the bag.

While the preferred embodiments of the invention have been illustrated and described, it should be understood that variations would be apparent to one skilled in the art. Accordingly, the invention is not to be limited to the specific embodiment illustrated in the drawing.

I claim:

1. A bag for use on a scoop device adapted to collect animal feces or other debris, comprising:

a flexible bag having a closed end and an open end joined by side walls;

a perforation in one of said side walls adapted to be passed through by a handle of the scoop device for positioning the bag on the scoop device, said perforation being located from the open end between 25 and 50 percent of the total length of the bag; and easily separable means joining the perforation and the open end of the bag for enlarging the perforation to the open end of the bag for removal of the bag.

2. The bag of claim 1, said easily separable means including a perforated line from the open end to the perforation.

3. The bag of claim 1, said perforation being located from the open end approximately 40 percent of the total length of the bag.

4. The bag of claim 1 in combination with a scoop device of the type having an elongated, flexible handle terminating in a flexible continuous rim, said bag perforation being inserted over said handle and abutting said rim, said bag side walls being reversed through said rim leaving a skirt defined by the side walls from the open end of the bag to the perforation and overlying the rim and most of the remainder of the exterior of the bag wherein the skirt wall exposed outwardly of the bag covers most of the remainder of the exterior of the bag and when removed by pulling the bag off the rim will become an interior surface of the bag whereby debris contacting the skirt will be contained within the bag after removal of the bag from the rim.

5. A scoop device having an elongated, flexible handle terminating in a flexible continuous rim, a flexible bag attached to the rim, said bag having an open end and a closed end joined by side walls having exterior and interior surfaces, said bag side wall being drawn through said rim and folded over the rim at the open end to form a skirt, the outer surface of the skirt being the reverse fold from the inner surface and thus becoming the interior surface of the side wall when the bag is removed, said skirt extending over about at least 50 percent of the remaining exterior surface of the bag to shield the exterior bag surface from debris contacting the bag.

6. The bag of claim 4 or 5, wherein said bag has a lower side wall tapering upwardly from the skirt for spacing the remaining closed end of the bag off the ground.

* * * * *